US006363340B1

(12) United States Patent
Sluijter et al.

(10) Patent No.: US 6,363,340 B1
(45) Date of Patent: Mar. 26, 2002

(54) TRANSMISSION SYSTEM WITH IMPROVED SPEECH ENCODER

(75) Inventors: Robert J. Sluijter; Rakesh Taori, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/316,984

(22) Filed: May 24, 1999

(30) Foreign Application Priority Data

May 26, 1998 (EP) ..... 98201734

(51) Int. Cl.[7] ..... G10L 19/04

(52) U.S. Cl. ..... 704/201; 704/219; 704/220; 704/226

(58) Field of Search ..... 704/201, 219, 704/220, 226

(56) References Cited

U.S. PATENT DOCUMENTS 5,657,422 A 8/1997 Janiszewski et al. ..... 704/228
5,717,824 A * 2/1998 Chhatwal ..... 704/222
5,845,244 A * 12/1998 Proust ..... 704/220
6,073,092 A * 6/2000 Kwon ..... 704/219
6,104,992 A * 8/2000 Gao et al. ..... 704/220
6,173,257 B1 * 1/2001 Gao ..... 704/220
6,240,386 B1 * 5/2001 Thyssen et al. ..... 704/220

FOREIGN PATENT DOCUMENTS

EP 0756267 A1 1/1997 ..... G10L/3/00
EP 0772186 A2 5/1997 ..... G10L/9/14
EP 0843301 A2 5/1998 ..... G01L/3/02

* cited by examiner

*Primary Examiner*—William Korzuch
*Assistant Examiner*—Susan McFadden
(74) *Attorney, Agent, or Firm*—Jack D. Slobod

(57) ABSTRACT

A speech transmission system with an input speech signal applied to a speech encoder for encoding the speech signal which is transmitted via a communication channel to a speech decoder. Background noise dependent processing elements in the speech encoder and/ or speech decoder are introduced to improve the performance of the transmission system. The parameters of the perceptual weighting filter in the speech encoder are derived by calculating linear prediction coefficients from a speech signal which is processed by means of a high pass filter. An adaptive post filter in a speech decoder is bypassed when the noise level exceeds a threshold value.

10 Claims, 4 Drawing Sheets

TRANSMISSION SYSTEM WITH IMPROVED SPEECH ENCODER

The present invention relates to a transmission system comprising a speech encoder for deriving an encoded speech signal from an input speech signal, the transmitting arrangement comprises transmit means for transmitting the encoded speech signal to a receiving arrangement, the receiving arrangement comprising a speech decoder for decoding the encoded speech signal.

Such transmission systems are used in applications in which speech signals have to be transmitted over a transmission medium with a limited transmission capacity, or have to be stored on storage media with a limited storage capacity. Examples of such applications are the transmission of speech signals over the Internet, transmission of speech signals from a mobile phone to a base station and vice versa and storage of speech signals on a CD-ROM, in a solid state memory or on a hard disk drive.

In a speech encoder the speech signal is analyzed by analysis means which determines a plurality of analysis coefficients for a block of speech samples, also known as a frame. A group of these analysis coefficients describes the short time spectrum of the speech signal. An other example of an analysis coefficient is a coefficient representing the pitch of a speech signal. The analysis coefficients are transmitted via the transmission medium to the receiver where these analysis coefficients are used as coefficients for a synthesis filter.

Besides the analysis parameters, the speech encoder also determines a number of excitation sequences (e.g. 4) per frame of speech samples. The interval of time covered by such excitation sequence is called a sub-frame. The speech encoder is arranged for finding the excitation signal resulting in the best speech quality when the synthesis filter, using the above mentioned analysis coefficients, is excited with said excitation sequences.

A representation of said excitation sequences is transmitted via the transmission channel to the receiver. In the receiver, the excitation sequences are recovered from the received signal and applied to an input of the synthesis filter. At the output of the synthesis filter a synthetic speech signal is available.

Experiments have shown that the speech quality of such a transmission system is substantially deteriorated when the input signal of the speech encoder comprises a substantial amount of background noise.

The object of the present invention is to provide a transmission system according to the preamble in which the speech quality is improved when the input signal of the speech encoder comprises a substantial amount of background noise.

To achieve said purpose, the transmission system according to the present invention is characterized in that the speech encoder and/or the speech decoder comprises background noise determining means for determining a background noise property of the speech signal, in that the speech encoder and/or the speech decoder comprises at least one background noise dependent element, and in that the speech encoder and/or speech decoder comprises adaptation means for changing at least one property of the background noise dependent element in dependence on the background noise property.

Experiments have shown that it is possible to enhance the speech quality if background noise dependent processing is performed in the speech encoder and/or in the speech decoder by using a background noise dependent element.

The background noise property can e.g. be the level of the background noise, but it is conceivable that other properties of the background noise signals are used. The background noise dependent element can e.g. be the codebook used for generating the excitation signals, or a filter used in the speech encoder or decoder.

A first embodiment of the invention is characterized in that in that the speech encoder comprises, a perceptual weighting filter for deriving a perceptually weighted error signal representing a perceptually weighted error between the input speech signal and a synthetic speech signal, and in that the background noise dependent element comprises the perceptual weighting filter.

In speech encoders, it is common to use a perceptual weighting filter for obtaining a perceptual weighted error signal representing a perceptual difference between the input speech signal and a synthetic speech signal based on the encoded speech signal. Experiments have shown that making the properties of the perceptual weighting filter dependent on the background noise property, results in an improvement of the quality of the reconstructed speech.

A further embodiment of the invention is characterized in that the speech encoder comprises analysis means for deriving analysis parameters from the input speech signal, the properties of the perceptual weighting filter are derived from the analysis parameters, and in that the adaptation means are arranged for providing altered analysis parameters representing the speech signal being subjected to a high pass filtering operation to the perceptual weighting filter.

Experiments have shown that the best results are obtained when some of the analysis parameters to be used with the perceptual weighting filter represent a high pass filtered input signal. These analysis parameters can be obtained by performing the analysis on a high pass filtered input signal, but it is also possible that the altered analysis parameters are obtained by performing a transformation on the analysis parameters.

A further embodiment of the invention is characterized in that the speech decoder comprises a synthesis filter for deriving a synthetic speech signal from the encoded speech signal, the speech decoder comprises a post processing means for processing the output signal from the synthesis filter, and in that the back ground noise dependent element comprises the post processing means.

In speech coding systems often post processing means, comprising e.g. a post filter, are used to enhance the speech quality. Such post processing means comprising a post filter enhances the formants with respect to the valleys in the spectrum. Under low background noise conditions, the use of this post processing means results in an improved speech quality. However, experiments have shown that the post processing means deteriorate the speech quality if a substantial amount of background noise is present. By making one or more properties of the post processing means dependent on a property of the background noise, the speech quality can be improved. An example of such a property is the transfer function of the post processing means.

The present invention will be explained with reference to the drawing figures

Figure 1:
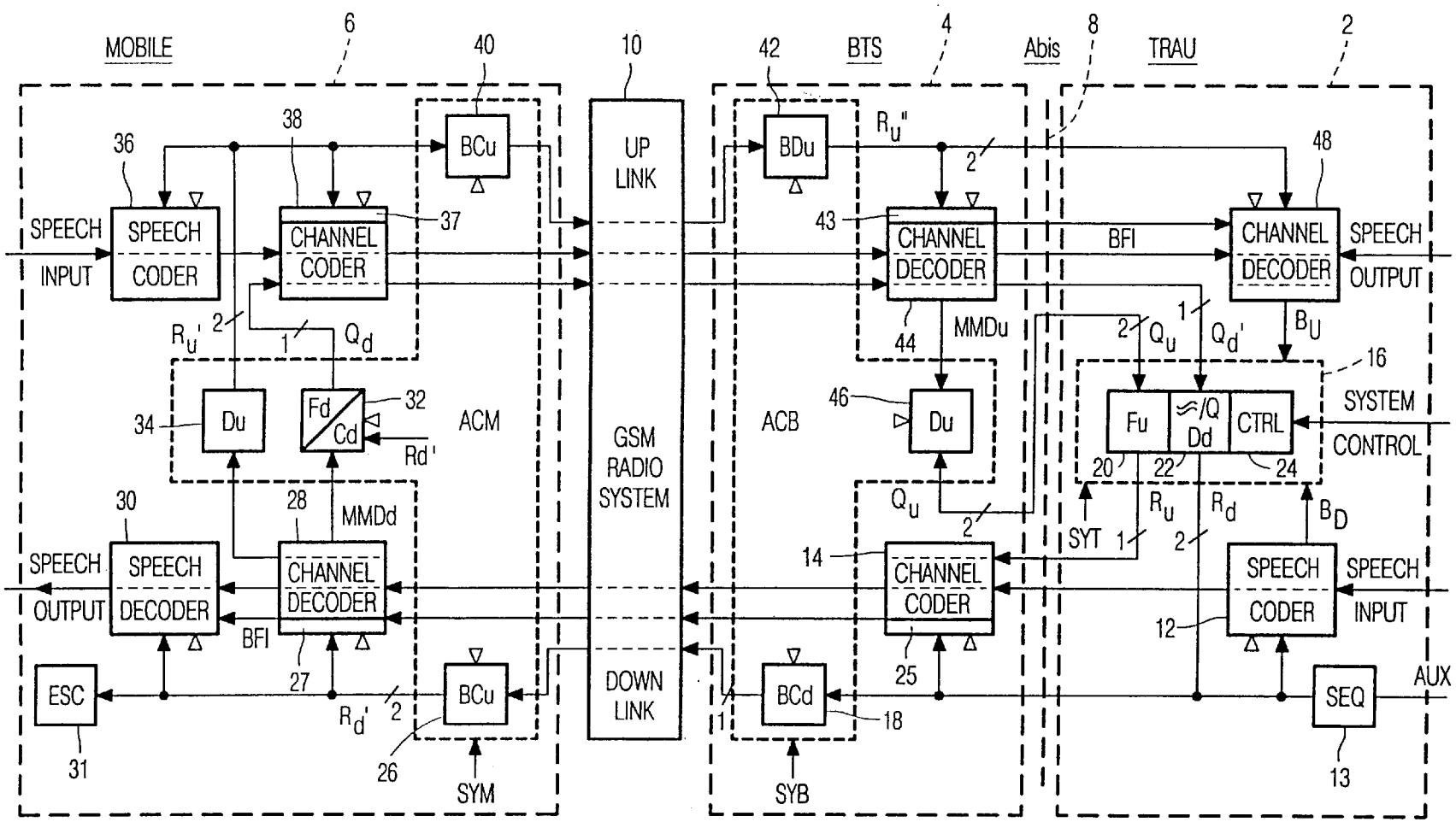
FIG. 1 shows a block diagram of a transmission system according to the invention.

The transmission system according to FIG. 1, comprises three important elements being the TRAU (Transcoder and Rate Adapter Unit) 2, the BTS (Base Transceiver Station) 4 and the Mobile Station 6. The TRAU 2 is coupled to the BTS 4 via the A-bis interface 8. The BTS 4 is coupled to the Mobile Unit 6 via an Air Interface 10.

A main signal being here a speech signal to be transmitted to the Mobile Unit 6, is applied to a speech encoder 12. A first output of the speech encoder 12 carrying an encoded speech signal, also referred to as source symbols, is coupled to a channel encoder 14 via the A-bis interface 8. A second output of the speech encoder 12, carrying a background noise level indicator $B_D$ is coupled to an input of a system controller 16. A first output of the system controller 16 carrying a coding property, being here a downlink rate assignment signal $R_D$ is coupled to the speech encoder 12 and, via the A-bis interface, to coding property setting means 15 in the channel encoder 14 and to a further channel encoder being here a block coder 18. A second output of the system controller 16 carrying an uplink rate assignment signal $R_U$ is coupled to a second input of the channel encoder 14. The two-bit rate assignment signal $R_U$ is transmitted bit by bit over two subsequent frames. The rate assignment signals $R_D$ and $R_U$ constitute a request to operate the downlink and the uplink transmission system on a coding property represented by $R_D$ and $R_U$ respectively.

It is observed that the value of $R_D$ transmitted to the mobile station 6 can be overruled by the coding property sequencing means 13 which can force a predetermined sequence of coding properties, as represented by the rate assignment signal $R_U$, onto the block encoder 18 the channel encoder 14 and the speech encoder 13. This predetermined sequence can be used for conveying additional information to the mobile station 6, without needing additional space in the transmission frame. It is possible that more than one predetermined sequence of coding properties is used. Each of the predetermined sequences of coding properties corresponds to a different auxiliary signal value.

The system controller 16 receives from the A-bis interface quality measures $Q_U$ and $Q_D$ indicating the quality of the air interface 10 (radio channel) for the uplink and the downlink. The quality measure $Q_U$ is compared with a plurality of threshold levels, and the result of this comparison is used by the system controller 16 to divide the available channel capacity between the speech encoder 36 and the channel encoder 38 of the uplink. The signal $Q_D$ is filtered by low pass filter 22 and is subsequently compared with a plurality of threshold values. The result of the comparison is used to divide the available channel capacity between the speech encoder 12 and the channel encoder 14. For the uplink and the downlink four different combinations of the division of the channel capacity between the speech encoder 12 and the channel encoder 14 are possible. These possibilities are presented in the table below.

TABLE 1

| $R_X$ | $R_{SPEECH}$(kbit/s) | $R_{CHANNEL}$ | $R_{TOTAL}$(kbit/s) |
|---|---|---|---|
| 0 | 5.5 | 1/4 | 22.8 |
| 1 | 8.1 | 3/8 | 22.8 |
| 2 | 9.3 | 3/7 | 22.8 |
| 3 | 11.1 | 1/2 | 22.8 |
| 0 | 5.5 | 1/2 | 11.4 |
| 1 | 7.0 | 5/8 | 11.4 |
| 2 | 8.1 | 3/4 | 11.4 |
| 3 | 9.3 | 6/7 | 11.4 |

From Table 1 it can be seen that the bitrate allocated to the speech encoder 12 and the rate of the channel encoder increases with the channel quality. This is possible because at better channel conditions the channel encoder can provide the required transmission quality (Frame Error Rate) using a lower bitrate. The bitrate saved by the larger rate of the channel encoder is exploited by allocating it to the speech encoder 12 in order to obtain a better speech quality. It is observed that the coding property is here the rate of the channel encoder 14. The cooling property setting means 15 are arranged for setting the rate of the channel encoder 14 according to the coding property supplied by the system controller 16.

Under bad channel conditions the channel encoder needs to have a lower rate in order to be able to provide the required transmission quality. The channel encoder will be a variable rate convolutional encoder which encodes the output bits of the speech encoder 12 to which an 8 bit CRC is added. The variable rate can be obtained by using different convolutional codes having a different basic rate or by using puncturing of a convolutional code with a fixed basic rate. Preferably a combination of these methods is used.

In Table 2 presented below the properties of the convolutional codes given in Table 1 are presented. All these convolutional codes have a value ν equal to 5.

TABLE 2

| Pol/Rate | 1/2 | 1/4 | 3/4 | 3/7 | 3/8 | 5/8 | 6/7 |
|---|---|---|---|---|---|---|---|
| $G_1$ = 43 | | | | | | | 000002 |
| $G_2$ = 45 | | | | 003 | | 00020 | |
| $G_3$ = 47 | | | 001 | | 301 | 01000 | |
| $G_4$ = 51 | | 4 | | | | 00002 | 101000 |
| $G_5$ = 53 | | | | 202 | | | |
| $G_6$ = 55 | | 3 | | | | | |
| $G_7$ = 57 | 2 | | | 020 | 230 | | |
| $G_8$ = 61 | | | 002 | | | | |
| $G_9$ = 65 | 1 | | 110 | | 022 | 02000 | 000001 |
| $G_{10}$ = 66 | | | | | | | |
| $G_{11}$ = 67 | | 2 | | | | | 000010 |
| $G_{12}$ = 71 | | | | 001 | | | |
| $G_{13}$ = 73 | | | | | 010 | | |
| $G_{14}$ = 75 | | | | 110 | 100 | 10000 | 000100 |
| $G_{15}$ = 77 | | 1 | | | | 00111 | 010000 |

In Table 2 the values $G_i$ represent the generator polynomials. The generator polynomials G(n) are defined according to:

$$G_i(D)=g_0 \oplus g_1 \cdot D \oplus \ldots \oplus g_{n-1} \cdot D^{n-1} \oplus g_n \cdot D^n \quad \text{(A)}$$

In (1) ⊕ is a modulo-2 addition. i is the octal representation of the sequence $g_0, g_1, \ldots g_{\nu-1}, g_\nu$.

For each of the different codes the generator polynomials used in it, are indicated by a number in the corresponding cell. The number in the corresponding cell indicates for which of the source symbols, the corresponding generator polynomial is taken into account. Furthermore said number indicates the position of the coded symbol derived by using said polynomial in the sequence of source symbols. Each digit indicates the position in the sequence of channel symbols, of the channel symbol derived by using the indicated generator polynomial. For the rate 1/2 code, the generator polynomials 57 and 65 are used. For each source symbol first the channel symbol calculated according to polynomial 65 is transmitted, and secondly the channel symbol according to generator polynomial 57 is transmitted. In a similar way the polynomials to be used for determining the channel symbols for the rate 1/4 code can be determined from Table 3. The other codes are punctured convolutional codes. If a digit in the table is equal to 0, it means that the corresponding generator polynomial is not used for said particular source symbol. From Table 2 can be seen that some of the generator polynomials are not used for each of the source symbols. It is observed that the sequences of numbers in the table are continued periodically for sequences of input symbols longer than 1, 3, 5 or 6 respectively.

It is observed that Table 1 gives the values of the bitrate of the speech encoder 12 and the rate of the channel encoder 14 for a full rate channel and a half rate channel. The decision about which channel is used is taken by the system operator, and is signaled to the TRAU 2, the BTS 4 and the Mobile Station 6, by means of an out of band control signal, which can be transmitted on a separate control channel. 16. To the channel encoder 14 also the signal $R_U$ is applied.

The block coder 18 is present to encode the selected rate $R_D$ for transmission to the Mobile Station 6. This rate $R_D$ is encoded in a separate encoder for two reasons. The first reason is that it is desirable to inform the channel decoder 28 in the mobile station of a new rate $R_D$ before data encoded according to said rate arrives at the channel decoder 28. A second reason is that it is desired that the value $R_D$ is better protected against transmission errors than it is possible with the channel encoder 14. To enhance the error correcting properties of the encoded $R_D$ value even more, the codewords are split in two parts which are transmitted in separate frames. This splitting of the codewords allows longer codewords to be chosen, resulting in further improved error correcting capabilities.

The block coder 18 encodes the coding property $R_D$ which is represented by two bits into an encoded coding property encoded according to a block code with codewords of 16 bits if a full rate channel is used. If a half rate channel is used, a block code with codewords of 8 bits are used to encode the coding property. The codewords used are presented below in Table 3 and Table 4.

TABLE 3

| | | Half Rate Channel | | | | | | | |
|---|---|---|---|---|---|---|---|---|---|
| $R_D[1]$ | $R_D[2]$ | $C_0$ | $C_1$ | $C_2$ | $C_3$ | $C_4$ | $C_5$ | $C_6$ | $C_7$ |
| 0 | 0 | 0 | 0 | 0 | 0 | 0 | 0 | 0 | 0 |
| 0 | 1 | 0 | 0 | 1 | 1 | 1 | 1 | 0 | 1 |
| 1 | 0 | 1 | 1 | 0 | 1 | 0 | 0 | 1 | 1 |
| 1 | 1 | 1 | 1 | 1 | 0 | 1 | 1 | 1 | 0 |

TABLE 4

| | | Full Rate Channel | | | | | | | | | | | | | | | |
|---|---|---|---|---|---|---|---|---|---|---|---|---|---|---|---|---|---|
| $R_D[1]$ | $R_D[2]$ | $C_0$ | $C_1$ | $C_2$ | $C_3$ | $C_4$ | $C_5$ | $C_6$ | $C_7$ | $C_8$ | $C_9$ | $C_{10}$ | $C_{11}$ | $C_{12}$ | $C_{13}$ | $C_{14}$ | $C_{15}$ |
| 0 | 0 | 0 | 0 | 0 | 0 | 0 | 0 | 0 | 0 | 0 | 0 | 0 | 0 | 0 | 0 | 0 | 0 |
| 0 | 1 | 0 | 0 | 1 | 1 | 1 | 1 | 0 | 1 | 0 | 0 | 1 | 1 | 1 | 1 | 0 | 1 |
| 1 | 0 | 1 | 1 | 0 | 1 | 0 | 0 | 1 | 1 | 1 | 1 | 0 | 1 | 0 | 0 | 1 | 1 |
| 1 | 1 | 1 | 1 | 1 | 0 | 1 | 1 | 1 | 0 | 1 | 1 | 1 | 0 | 1 | 1 | 1 | 0 |

From Table 3 and Table 4, it can be seen that the codewords used for a full rate channel are obtained by repeating the codewords used for a half rate channel, resulting in improved error correcting properties. In a half-rate channel, the symbols $C_0$ to $C_3$ are transmitted in a first frame, and the bits $C_4$ to $C_7$ are transmitted in a subsequent frame. In a full-rate channel, the symbols $C_0$ to $C_7$ are transmitted in a first frame, and the bits $C_8$ to $C_{15}$ are transmitted in a subsequent frame.

The outputs of the channel encoder 14 and the block encoder 18 are transmitted in time division multiplex over the air interface 10. It is however also possible to use CDMA for transmitting the several signals over the air interface 10. In the Mobile Station 6, the signal received from the air interface 10 is applied to a channel decoder 28 and to a further channel decoder being here a block decoder 26. The block decoder 26 is arranged for deriving the coding property represented by the $R_D$ bits by decoding the encoded coding property represented by codeword $C_0 \ldots C_N$, in which N is 7 for the half rate channel and N is 15 for the full rate channel.

The block decoder 26 is arranged for calculating the correlation between the four possible codewords and its input signal. This is done in two passes because the codewords are transmitted in parts in two subsequent frames. After the input signal corresponding to the first part of the codeword has been received, the correlation value between the first parts of the possible codewords and the input value are calculated and stored. When in the subsequent frame, the input signal corresponding to the second part of the codeword is received, the correlation value between the second parts of the possible codewords and the input signal are calculated and added to the previously stored correlation value, in order to obtain the final correlation values. The value of $R_D$ corresponding to the codeword having the largest correlation value with the total input signal, is selected as the received codeword representing the coding property, and is passed to the output of the block decoder 26. The output of the block decoder 26 is connected to a control input of the property setting means in the channel decoder 28 and to a control input of the speech decoder 30 for setting the rate of the channel decoder 28 and the bitrate of the speech decoder 30 to a value corresponding to the signal $R_D$.

The channel decoder 28 decodes its input signal, and presents at a first output an encoded speech signal to an input of a speech decoder 30.

The channel decoder 28 presents at a second output a signal BFI (Bad Frame Indicator) indicating an incorrect reception of a frame. This BFI signal is obtained by calculating a checksum over a part of the signal decoded by a convolutional decoder in the channel decoder 28, and by comparing the calculated checksum with the value of the checksum received from the air interface 10.

The speech decoder 30 is arranged for deriving a replica of the speech signal of the speech encoder 12 from the output signal of the channel decoder 20. In case a BFI signal is received from the channel decoder 28, the speech decoder 30 is arranged for deriving a speech signal based on the previously received parameters corresponding to the previous frame. If a plurality of subsequent frames are indicated as bad frame, the speech decoder 30 can be arranged for muting its output signal.

The channel decoder 28 provides at a third output the decoded signal $R_U$. The signal $R_U$ represents a coding property being here a bitrate setting of the uplink. Per frame the signal $R_U$ comprises 1 bit (the RQI bit). In a deformatter 34 the two bits received in subsequent frames are combined in a bitrate setting $R_U'$ for the uplink which is represented by two bits. This bitrate setting $R_U'$ which selects one of the possibilities according to Table 1 to be used for the uplink is applied to a control input of a speech encoder 36, to a control input of a channel encoder 38, and to an input of a further channel encoder being here a block encoder 40. If the channel decoder 20 signals a bad frame by issuing a BFI signal, the decoded signal $R_U$ is not used for setting the uplink rate, because it is regarded as unreliable The channel decoder 28 provides at a fourth output a quality measure MMDd. This measure MMD can easily be derived when a Viterbi decoder is used in the channel decoder. This quality measure is filtered in the processing unit 32 according to a first order filter. For the output signal of the filter in the processing unit 32 can be written:

$$MMD'[n]=(1-\alpha)\cdot MMD[n]+\alpha\cdot MMD'[n-1] \quad (B)$$

After the bitrate setting of the channel decoder 28 has been changed in response to a changed value of $R_D$, the value of MMD'[n−1] is set to a typical value corresponding to the long time average of the filtered MMD for the newly set bitrate and for a typical downlink channel quality. This is done to reduce transient phenomena when switching between different values of the bitrate.

The output signal of the filter is quantized with 2 bits to a quality indicator $Q_D$. The quality indicator $Q_D$ is applied to a second input of the channel encoder 38. The 2 bit quality indicator $Q_D$ is transmitted once each two frames using one bit position in each frame.

A speech signal applied to the speech encoder 36 in the mobile station 6 is encoded and passed to the channel encoder 38. The channel encoder 38 calculates a CRC value over its input bits, adds the CRC value to its input bits, and encodes the combination of input bits and CRC value according to the convolutional code selected by the signal $R_U'$ from Table 1.

The block encoder 40 encodes the signal $R_U'$ represented by two bits according to Table 3 or Table 4 dependent on whether a half-rate channel or a full-rate channel is used. Also here only half a codeword is transmitted in a frame.

The output signals of the channel encoder 38 and the block encoder 40 in the mobile station 6 are transmitted via the air interface 10 to the BTS 4. In the BTS 4, the block coded signal $R_U'$ is decoded by a further channel decoder being here a block decoder 42. The operation of the block decoder 42 is the same as the operation of the block decoder 26. At the output of the block decoder 42 a decoded coding property represented by a signal $R_U''$ is available. This decoded signal $R_U''$ is applied to a control input of coding property setting means in a channel decoder 44 and is passed, via the A-bis interface, to a control input of a speech decoder 48.

In the BTS 4, the signals from the channel encoder 38, received via the air interface 10, are applied to the channel decoder 44. The channel decoder 44 decodes its input signals, and passes the decoded signals via the A-bis interface 8 to the TRAU 2. The channel decoder 44 provides a quality measure MMDu representing the transmission quality of the uplink to a processing unit 46. The processing unit 46 performs a filter operation similar to that performed in the processing unit 32 and 22. Subsequently the result of the filter operation is quantized in two bits and transmitted via the A-bis interface 8 to the TRAU 2.

In the system controller 16, a decision unit 20 determines the bitrate setting $R_U$ to be used for the uplink from the quality measure $Q_U$. Under normal circumstances, the part of the channel capacity allocated to the speech coder will increase with increasing channel quality. The rate $R_U$ is transmitted once per two frames.

The signal $Q_D'$ received from the channel decoder 44 is passed to a processing unit 22 in the system controller 16. In the processing unit 22, the bits representing $Q_D'$ received in two subsequent frames are assembled, and the signal $Q_D'$ is filtered by a first order low-pass filter, having similar properties as the low pass filter in the processing unit 32.

The filtered signal $Q_D'$ is compared with two threshold values which depend on the actual value of the downlink rate $R_D$. If the filtered signal $Q_D'$ falls below the lowest of said threshold value, the signal quality is too low for the rate $R_D$, and the processing unit switches to a rate which is one step lower than the present rate. If the filtered signal $Q_D'$ exceeds the highest of said threshold values, the signal quality is too high for the rate $R_D$, and the processing unit switches to a rate which is one step higher than the present rate. The decision taking about the uplink rate $R_U$ is similar as the decision taking about the downlink rate $R_D$.

Again, under normal circumstances, the part of the channel capacity allocated to the speech coder will increase with increasing channel quality. Under special circumstances the signal $R_D$ can also be used to transmit a reconfiguration signal to the mobile station. This reconfiguration signal can e.g. indicate that a different speech encoding/decoding and or channel coding/decoding algorithm should be used. This reconfiguration signal can be encoded using a special predetermined sequence of $R_D$ signals. This special predetermined sequence of $R_D$ signals is recognised by an escape sequence decoder 31 in the mobile station, which is arranged for issuing a reconfiguration signal to the effected devices when a predetermined (escape) sequence has been detected. The escape sequence decoder 30 can comprise a shift register in which subsequent values of $R_D$ are clocked. By comparing the content of the shift register with the predetermined sequences, it can easily be detected when an escape sequence is received, and which of the possible escape sequences is received.

An output signal of the channel decoder 44, representing the encoded speech signal, is transmitted via the A-Bis interface to the TRAU 2. In the TRAU 2, the encoded speech signal is applied to the speech decoder 48. A signal BFI at the output of the channel decoder 44, indicating the detecting of a CRC error, is passed to the speech decoder 48 via the A-Bis interface 8. The speech decoder 48 is arranged for deriving a replica of the speech signal of the speech encoder 36 from the output signal of the channel decoder 44. In case a BFI signal is received from the channel decoder 44, the speech decoder 48 is arranged for deriving a speech signal based on the previously received signal corresponding to the previous frame, in the same way as is done by the speech decoder 30. If a plurality of subsequent frames are indicated as bad frame, the speech decoder 48 can be arranged for performing more advanced error concealment procedures.

Figure 2:
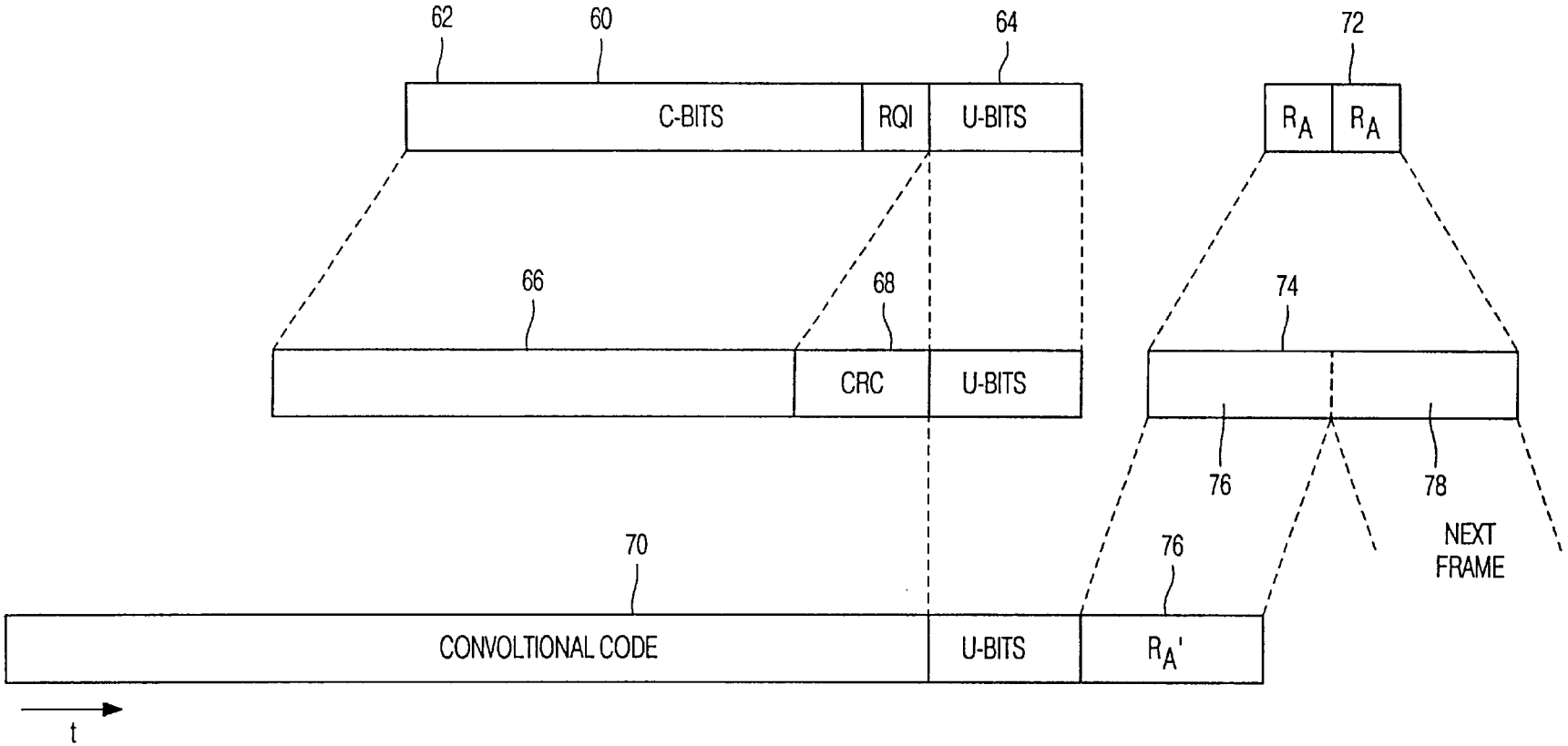
FIG. 2 shows a frame format for use with a transmission system according to the present invention.

FIG. 2 shows the frame format used in a transmission system according to the invention. The speech encoder 12 or 36 provides a group 60 of C-bits which should be protected against transmission errors, and a group 64 of U-bits which do not have to be protected against transmission errors. The further sequence comprises the U-bits. The decision unit 20 and the processing unit 32 provide one bit RQI 62 per frame for signalling purposes as explained above.

The above combination of bits is applied to the channel encoder 14 or 38 which first calculates a CRC over the combination of the RQI bit and the C-bits, and appends 8

CRC bits behind the C-bits 60 and the RQI bit 62. The U-bits are not involved with the calculation of the CRC bits. The combination 66 of the C-bits 60 and the RQI bit 62 and the CRC bits 68 are encoded according to a convolutional code into a coded sequence 70. The encoded symbols comprise the coded sequence 70. The U-bits remain unchanged.

The number of bits in the combination 66 depends on the rate of the convolutional encoder and the type of channel used, as is presented below in Table 5.

TABLE 5

| # bits/rate | 1/2 | 1/4 | 3/4 | 3/7 | 3/8 | 5/8 | 6/7 |
|---|---|---|---|---|---|---|---|
| Full rate | 217 | 109 | | 189 | 165 | | |
| Half rate | 105 | | 159 | | | 125 | 174 |

The two $R_A$ bits which represent the coding property are encoded in codewords 74, which represent the encoded coding property, according the code displayed in Table 3 or 4, dependent on the available transmission capacity (half rate or full rate). This encoding is only performed once in two frames. The codewords 74 are split in two parts 76 and 78 and transmitted in the present frame and the subsequent frame.

Figure 3:
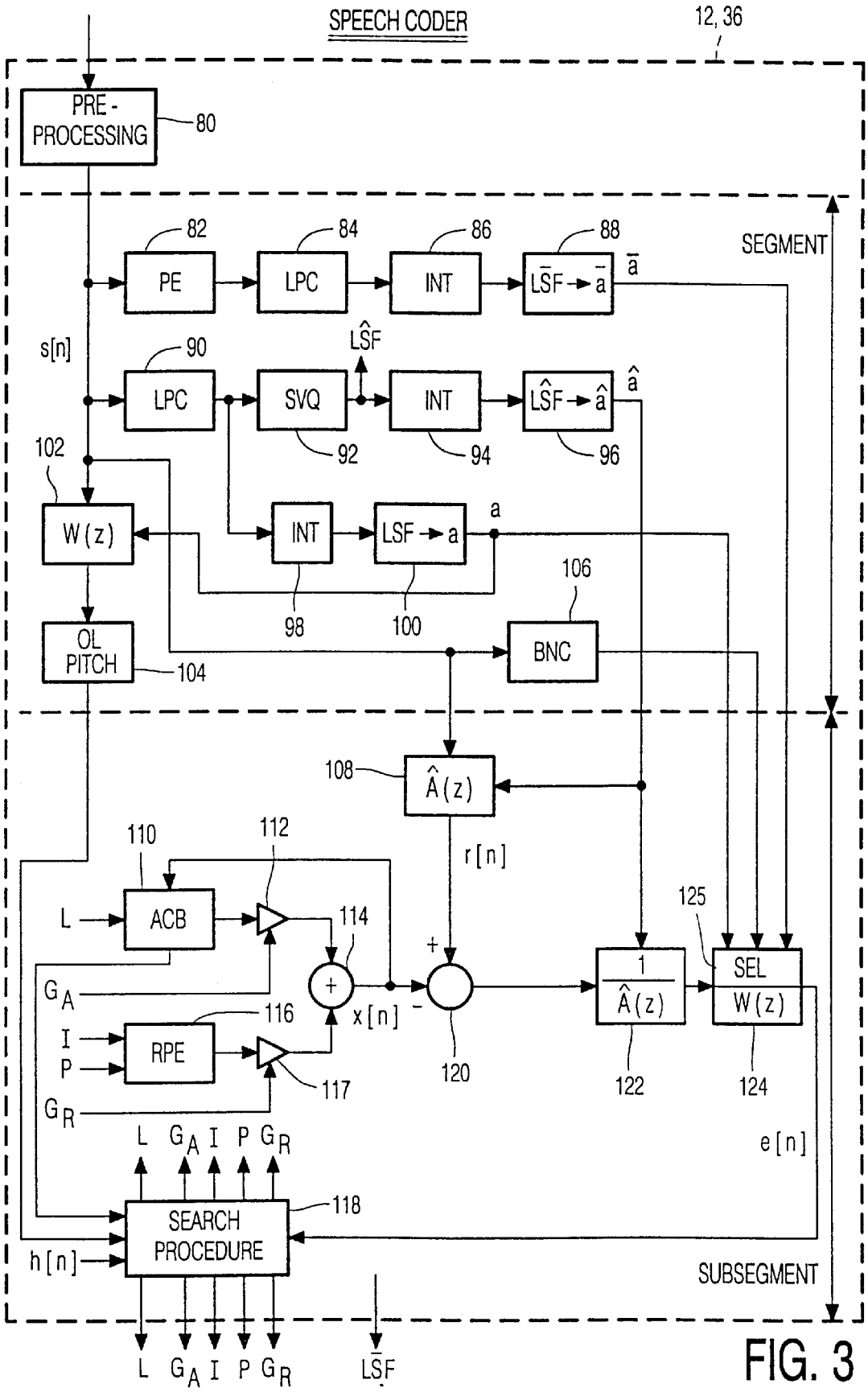
FIG. 3 shows a block diagram of a speech encoder according to the present invention.

In the speech encoder 12, 36 according to FIG. 3, an input speech signal is subjected to a pre-processing operation which comprises a high-pass filtering operation using a high-pass filter 80 with a cut-off frequency of 80 Hz. The output signal s[n] of the high-pass filter 80 is segmented into frames of 20 msec each. The speech signal frames are applied to the input of the analysis means, being a linear prediction analyser 90 which calculates a set of 10 LPC coefficients from the speech signal frames. In the calculation of the LPC parameters, the most recent part of the frame is emphasized by using a suitable window function. The calculation of the LPC coefficients is done with the well known Levinson-Durbin recursion.

An output of the linear predictive analyser 90, carrying the analysis result in the form of Line Spectral Frequencies (LSF's), is connected to a split vector quantizer 92. In the split vector quantizer 92 the LSF's are split in three groups, two groups comprising 3 LSF's and one group comprising 4 LSF's. Each of the groups is vector quantized, and consequently the LSF's are represented by three codebook indices. These codebook indices are made available as output signal of the speech encoder 12, 36.

The output of the split vector quantizer 94 is also connected to an input of an interpolator 94. The interpolator 94 derives the LSF's from the codebook entries, and interpolates the LSF's of two subsequent frames to obtain interpolated LSF's for each of four sub-frames with a duration of 5 ms. The output of the interpolator 94 is connected to an input of a converter 96 which converts the interpolated LSF's into a-parameters $\hat{a}$. These $\hat{a}$ parameters are used for controlling the coefficients of filters 108 and 122 which are involved with the analysis by synthesis procedure, which will be explained below.

Besides the $\hat{a}$ parameters two slightly differing sets of a-parameters a and $\bar{a}$ are determined. The set parameters a are determined by interpolating the Line Spectral Frequencies before they are vector quantized by means of an interpolator 98. The parameters a are finally obtained by converting the LSP's into a-parameters by means of a converter 100. The parameters a are used to control a perceptually weighted analysis filter 102 and the perceptual weighting filter 124.

The third set of a parameters $\bar{a}$ is obtained by first performing a pre-emphasis operation on the speech signal s[n] by a high pass filter 82 with transfer function $1-\mu \cdot z^{-1}$, with $\mu$ having a value of 0.7. Subsequently the LSF's are calculated by the further analysis means, being here a predictive analyser 84. An interpolator 86 calculates interpolated LSF's for the sub-frames, and a converter 88 converts the interpolated LSF's into the a-parameters $\bar{a}$. These parameters $\bar{a}$ are used for controlling the perceptual weighting filter 124 when the background noise in the speech signal exceeds a threshold value.

The speech encoder 12, 36 uses an excitation signal generated by a combination of an adaptive codebook 110 and a RPE (Regular Pulse Excitation) codebook 116. The output signal of the RPE codebook 116 is defined by a codebook index I and a phase P which defines the position of the grid of equidistant pulses generated by the RPE codebook 116. The signal I can e.g. be a concatenation of a five bit Gray coded vector representing three ternary excitation samples and an eight bit Gray coded vector representing five ternary excitation samples. The output of the adaptive codebook 110 is connected to the input of a multiplier 112 which multiplies the output signal of the adaptive codebook 110 with a gain factor $G_A$. The output of the multiplier 112 is connected to a first input of an adder 114.

The output of the RPE codebook 116 is connected to the input of a multiplier 117 which multiplies the output signal of the RPE codebook 116 with a gain factor $G_R$. The output of the multiplier 117 is connected to a second input of the adder 114. The output of the adder 114 is connected to an input of the adaptive codebook 110 for supplying the excitation signal to said adaptive codebook 110 in order to adapt its content. The output of the adder 114 is also connected to a first input of a subtractor 120.

An analysis filter 108 derives a residual signal r[n] from the signal s[n] for each of the subframes. The analysis filter uses the prediction coefficients $\hat{a}$ as delivered by the converter 96. The subtractor 120 determines the difference between the output signal of the adder 114 and the residual signal at the output signal of the analysis filter 108. The output signal of the subtractor 120 is applied to a synthesis filter 122, which derives an error signal which represents a difference between the speech signal s[n] and a synthetic speech signal generated by filtering the excitation signal by the synthesis filter 122. In the present encoder the residual signal r[n] is made explicitly available because it is needed in the search procedure as will be explained below.

The output signal of the synthesis filter 122 is filtered by a perceptual weighting filter 124 to obtain a perceptually weighted error signal e[n]. The energy of this perceptually weighted error signal e[n] is to be minimized by the excitation selection means 118 by selecting optimum values for the excitation parameters L, $G_A$, I, P and $G_R$.

The signal s[n] is also applied to the background noise determination means 106 which determines the level of the background noise. This is done by tracking the minimum frame energy with a time constant of a few seconds. If this minimum frame energy which is assumed to be caused by background noise exceeds a threshold value the presence of background noise is signaled at the output of the background noise determination means 106.

After reset of the speech encoder, an initial value of the background noise level is set to the maximum frame energy in the first 200 ms after said reset. Such a reset takes place at the establishment of a call. It is assumed that in these very first 200 ms after reset no speech signal is applied to the speech encoder.

According to one aspect of the present invention, the operation of the perceptual weighting filter 124 is made dependent on the background noise level by the adaptation means which comprise here a selector 125. When no background noise is present, the transfer function of the perceptual weighting filter is equal to $$W(z) = \frac{A(z/\gamma_1)}{A(z/\gamma_2)} \tag{C}$$

In (2) A(z) is equal to $$A(z) = 1 - \sum_{i=0}^{P-1} a_i \cdot z^{-i-1} \tag{D}$$

In (3) $a_i$ represents the prediction parameters a available at the output of the converter 100. $\gamma_1$ and $\gamma_2$ are positive constants smaller than 1.

When the background noise level exceeds a threshold, the transfer function W(z) of the perceptual weighting filter is made equal to $$W(z) = \frac{A(z/\gamma_1)}{\bar{A}(z/\gamma_2)} \tag{E}$$

In (3) $\bar{A}$ represent the polynomial according to (3), but now based on the prediction parameters $\bar{a}$ available at the output of the converter 88.

When almost no background noise is present, the weighting filter 124 has the transfer function according to (2) and puts most emphasis on the conceptually more important low frequencies of the speech signal so that they are encoded in a more accurate way. If the background noise exceeds a given threshold value, it is desirable to put relieve this emphasis. In this case, the higher frequencies are encoded more accurately at the cost of the accuracy of the lower frequencies. This makes the encoded speech signal sound more transparent. The de-emphasis on the lower frequencies is obtained by the filtering of the speech signal s[n] by the high-pass filter 82 before determining the prediction coefficients $\bar{a}$.

In order to determine the optimum entry of the adaptive codebook, a coarse value of the pitch of the speech signal is determined by a pitch detector 104 from a residual signal which is delivered by the perceptual weighting filter 102.

This coarse value of the pitch is used as starting value for a closed loop adaptive codebook search. The excitation selection means 118 first starts with selecting the parameters of the adaptive codebook 110 for the current frame under the assumption that the RPE codebook 116 gives no contribution. After having found the best lag value L and the best adaptive codebook gain $G_A$, the latter being quantized, are being made available for transmission. Subsequently the error due to the adaptive codebook search is eliminated from the error signal e[n] by calculating a new error signal by filtering the difference between the residual signal r[n] and the output signal of the adaptive codebook entry scaled with the quantized gain factor. This filtering is performed by a filter having a transfer function $W(z)/\hat{A}(z)$ .

Secondly the parameters of the RPE codebook 116 are determined by minimizing the energy in one sub-frame of the new error signal. This results in an optimum value of the RPE codebook index I, the RPE codebook phase P and the RPE codebook gain $G_R$. After the latter has been quantized, the values of I, P and the quantized value $G_R$ are made available for transmission.

After all excitation parameters have been determined, the excitation signal x[n] is calculated and written in the adaptive code book 110.

Figure 4:
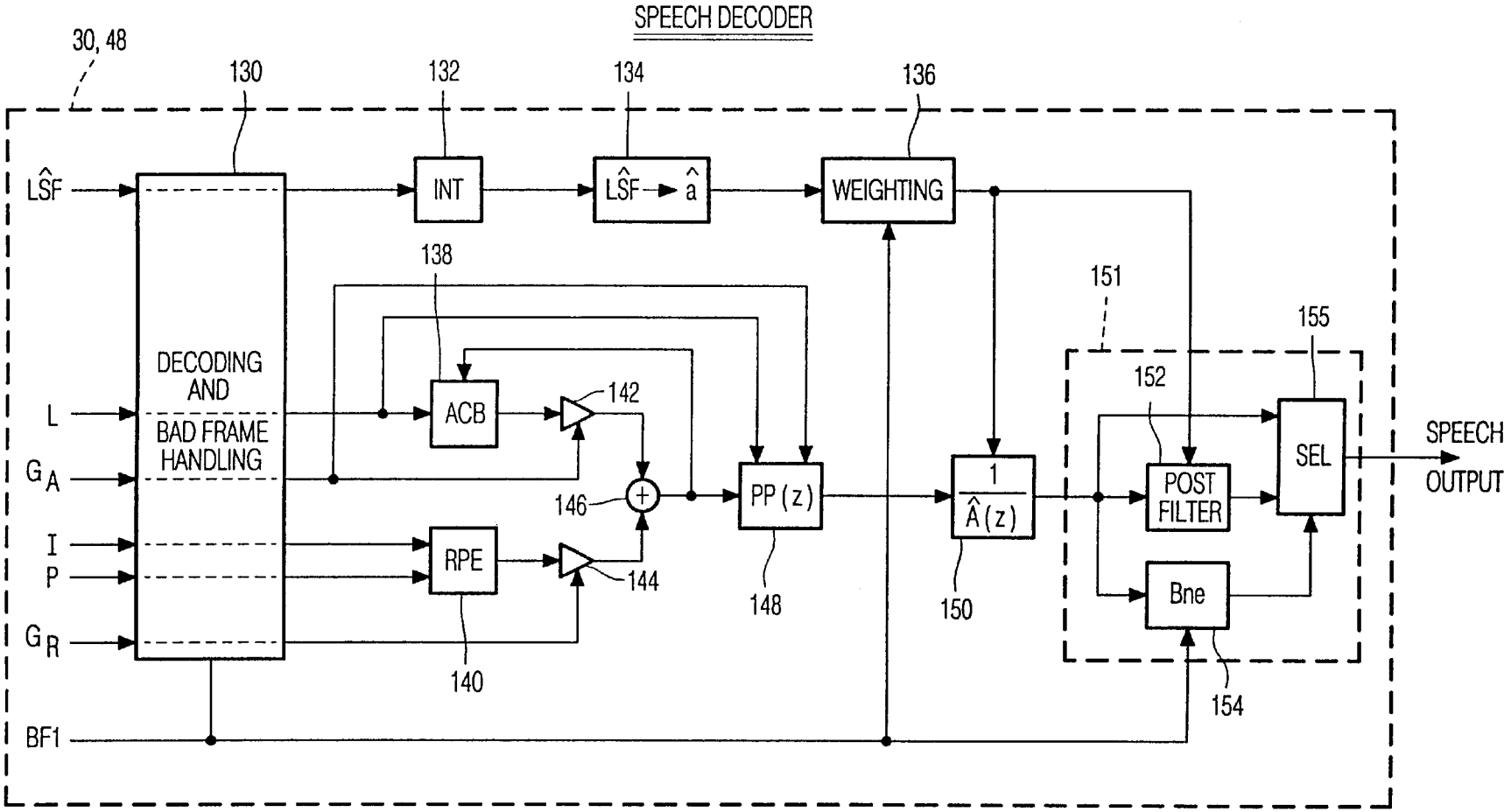
FIG. 4 shows a block diagram of a speech decoder according to the present invention.

In the speech decoder according to FIG. 4, the encoded speech signal represented by the parameters $L\hat{S}F$, L, $G_A$, I, P and $G_R$ is applied to a decoder 130. Further the bad frame indicator BFI delivered by the channel decoder 28 or 44 is applied to the decoder 130.

The signals L and $G_A$ representing the adaptive codebook parameters are decoded by the decoder 130 and supplied to an adaptive codebook 138 and a multiplier 142 respectively. The signals I, P and $G_R$ representing the RPE codebook parameters, are decoded by the decoder 130 and supplied to an RPE codebook 140 and a multiplier 144 respectively. The output of the multiplier 142 is connected to a first input of an adder 146 and the output of the multiplier 144 is connected to a second input of the adder 146.

The output of the adder 146, which carries the excitation signal, is connected to an input of a pitch pre-filter 148. The pitch pre-filter 148 receives also the adaptive codebook parameters L and $G_A$. The pitch pre-filter 148 enhances the periodicity of the speech signal on the basis of the parameters L and $G_A$.

The output of the pitch pre-filter 148 is connected to a synthesis filter 150 with transfer function $1/\hat{A}(z)$. The synthesis filter 150 provides a synthetic speech signal. The output of the synthesis filter 150 is connected to a first input of the post processing means 151, and to an input of background noise detection means 154. The output of the background noise detection means 154, carrying a control signal, is connected to a second input of the post processing means 151.

In the post processing means 151, the first input is connected to an input of a post filter 152 and to a first input of a selector 155. The output of the post filter 152 is connected to a second input of the selector 155. The output of the selector 155 is connected to the output of the post processing means 151. The second input of the post processing means is connected to a control input of the selector 155.

According to an aspect of the present invention, the background noise dependent element in the decoder according to FIG. 4 comprises the post processing means 151, and the background noise dependent property is the transfer function of the post processing means 151.

If the control signal at the second input of the post processing means signals that the level of the background noise in the speech signal is below the threshold value, the output of the post filter 152 is connected to the output of the speech decoder by the selector 155. The conventional post filter operates on a sub-frame basis and comprises the usual long term and short term parts, an adaptive tilt compensation, a high pass filter with a cut off frequency of 100 Hz and a gain control to keep the energy of the input signal and the output signal of the post filter equal.

The long term part of the post filter 152 operates with a fractional delay which is locally searched in the neighbourhood of the received value of L. This search is based on finding the maximum of the short term autocorrelation function of a pseudo residual signal which is obtained by filtering the output signal of the synthesis filter with an analysis filter $\hat{A}(z)$ with parameters based on the prediction parameters $\hat{a}$.

If the background noise detection means 154 signal that the background noise exceeds a threshold value, the selector 155 connects the output of the synthesis filter directly to the output of the speech decoder, causing the post filter 152 effectively to be switched off. This has the advantage that the speech decoder sounds more transparent in the presence of background noise.

When the post filter is by-passed, it is not switched off, but it remains active. This has the advantage that no transient phenomena occur when the selector 155 switches back to the output of the post filter 152, when the background noise level falls below the threshold value.

It is observed that it is also conceivable to change the parameters of the post filter 152 in response to the background noise level.

The operation of the background noise detection means 154 is the same as the operation of the background noise detection means 106 as is used in the speech encoder according to FIG. 3. If a bad frame is signaled by the BFI indicator, the background noise detection means 154 remain in the state corresponding to the last frame received correctly.

The signal LŜF is applied to an interpolator 132 for obtaining interpolated Line Spectral Frequencies for each sub-frame. The output of the interpolator 132 is connected to an input of a converter 134 which converts the Line Spectral Frequencies into a-parameters â. The output of the converter 134 is applied to a weighting unit 136 which is under control of the bad frame indicator BFI. If no bad frames occur, the weighting unit 136 is inactive and passes its input parameters â unaltered to its output. If a bad frame occurs, the weighting unit 136 switches to an extrapolation mode. In extrapolating the LPC parameters, the last set â of the previous frame is copied and is provided with bandwidth expansion. If successive bad frames occur, the bandwidth expansion is applied recursively so that the corresponding spectral representation will flatten out. The output of the weighting unit 136 is connected to an input of the synthesis filter 150 and to an input of the post filter 152, in order to provide them with the prediction parameters â.

What is claimed is:

1. A speech encoder, comprising:

means for determining a level of background noise in a speech signal; and a perceptually weighted filter operable to provide a perceptually weighted error signal representing a perceptually weighted error between the speech signal and a synthetic speech signal, wherein said perceptually weighted filter operates in accordance with a first transfer function when the level of the background noise is equal to or less than a threshold value, and wherein said perceptually weighted filter operates in accordance with a second transfer function when the level of the background noise is greater than the threshold value.

2. The speech encoder of claim 1, further comprising means for deriving a first set of linear prediction coefficients from the speech signal;

high pass filter operable to filter the speech signal; and means for deriving a second set of linear prediction coefficients from the speech signal as filtered by the high pass filter.

3. The speech encoder of claim 2, wherein the first set of linear prediction coefficients are variables of the first transfer function, and the second set of linear prediction coefficients are variables of the second transfer function.

4. A transmission system, comprising:

a speech encoder operable to provide an encoded speech signal; and a speech decoder operable to decode the encoded speech signal, wherein said speech encoder includes means for determining a level of background noise in a speech signal, and a perceptually weighted filter operable to provide a perceptually weighted error signal representing a perceptually weighted error between the speech signal and a synthetic speech signal, said perceptually weighted filter operating in accordance with a first transfer function when the level of the background noise is equal to or less than a threshold value, and said perceptually weighted filter operates in accordance with a second transfer function when the level of the background noise is greater than the threshold value.

5. The transmission system of claim 4, wherein said speech encoder further includes:

means for deriving a first set of linear prediction coefficients from the speech signal;

high pass filter operable to filter the speech signal; and means for deriving a second set of linear prediction coefficients from the speech signal as filtered by the high pass filter.

6. The transmission system of claim 5, wherein the first set of linear prediction coefficients are variables of the first transfer function, and the second set of linear prediction coefficients are variables of the second transfer function.

7. The transmission system of claim 4, wherein said speech decoder includes:

an output;

a post filter in electrical communication with said output when the level of the background noise is equal to or less than a threshold value; and a synthesis filter in electrical communication with said output when the level of the background noise is greater than the threshold value.

8. A speech encoding method, comprising:

determining a level of background noise in a speech signal;

providing a perceptually weighted error signal representing a perceptually weighted error between the speech signal and a synthetic speech signal in accordance with a first transfer function when the level of the background noise is equal to or less than a threshold value; and providing a perceptually weighted error signal representing a perceptually weighted error between the speech signal and a synthetic speech signal in accordance with a second transfer function when the level of the background noise is greater than the threshold value.

9. The speech encoding method of claim 8, further comprising deriving a first set of linear prediction coefficients from the speech signal;

filtering the speech signal through a high pass filter; and deriving a second set of linear prediction coefficients from the speech signal as filtered by the high pass filter.

10. The speech encoding method of claim 9, further comprising:

applying the first set of linear prediction coefficients as variables of the first transfer function when the level of the background noise is equal to or less than the threshold value, and applying the second set of linear prediction coefficients as variables of the second transfer function when the level of the background noise is greater than the threshold value.

* * * * *